US007263966B1

(12) United States Patent
Robison

(10) Patent No.: US 7,263,966 B1
(45) Date of Patent: Sep. 4, 2007

(54) DUAL ACTION CYLINDER

(76) Inventor: Mark Andrew Robison, 605 Suhtai Ct., Apt. 203, Virginia Beach, VA (US) 23451

( * ) Notice: Subject to any disclaimer, the term of this patent is extended or adjusted under 35 U.S.C. 154(b) by 0 days.

(21) Appl. No.: 11/467,317

(22) Filed: Aug. 25, 2006

(51) Int. Cl.
*F02B 75/22* (2006.01)
*F02B 75/32* (2006.01)

(52) U.S. Cl. ..... 123/197.1; 123/55.2; 74/50

(58) Field of Classification Search ..... 123/197.1, 123/197.2, 55.2; 74/25, 44, 50
See application file for complete search history.

(56) References Cited

U.S. PATENT DOCUMENTS 5,375,566 A * 12/1994 Brackett ..... 123/197.1

* cited by examiner

*Primary Examiner*—Noah P. Kamen
(74) *Attorney, Agent, or Firm*—Duncan G. Byers

(57) ABSTRACT

A device for translating linear reciprocal motion to rotational motion includes a reciprocating linearly moving piston with a central slot. The aperture has a set of recessed annular gears opposite each other which engage corresponding gear teeth on a cog located on a crankshaft that rotates inside the piston. Connecting braces on the crankshaft imparts an offset on the crankshaft and a corresponding lateral force on the cog, keeping the cog engaged with the recessed annular gear which imparts a rotational force upon the crankshaft.

5 Claims, 4 Drawing Sheets

DUAL ACTION CYLINDER

BACKGROUND

This invention relates to reciprocating piston engines, and more particularly those reciprocating piston engines that translate a reciprocating linear movement of a piston into a circular or rotational movement of a crankshaft so as to impart power out of the engine.

Previous classes of piston engines relied upon a piston with a single combustion chamber, such as the device taught in U.S. Pat. No. 1,636,612 to NOAH, issued Jul. 19, 1927, entitled "Internal-combustion engine." More efficient double-ended pistons, such as that taught in U.S. Pat. No. 4,941,396 to MCABE, issued Jul. 17, 1990, entitled "Reciprocating double-ended piston," rely upon a design that reduces the size and number of component parts for a piston engine.

There are numerous designs for translating the linear motion of a piston into a rotational motion. Generally, single ended pistons translate the linear piston motion into rotational motion through a connecting rod attached to a crankshaft, with the connecting rod imparting rotational motion to the crankshaft. This design, however, is not the most efficient means of imparting rotational motion upon a crankshaft. The number of connecting and moving parts reduces the overall efficiency of the engine.

In an attempt to gain more efficiency and power with less space, internal combustion engines have been designed with double-ended pistons, such as those disclosed in U.S. Pat. No. 1,776,895 to GEORGE, issued Sep. 30, 1930, entitled "Double-acting internal-combustion engine," U.S. Pat. No. 2,094,830 to DAVID, issued Oct. 5, 1937, entitled "Multiple cylinder engine," U.S. Pat. No. 2,304,407 to HOGAN, issued Dec. 8, 1942, and U.S. Pat. No. 2,335,252 to APPEMAN, issued Nov. 30, 1943, entitled "Internal combustion engine."

A double-ended piston, with combustion chambers located at each end of the piston, however, requires that the linear motion be translated from the piston in a different manner than that employed in a cylinder with a single combustion chamber. Numerous designs have attempted to solve the problem of translating the linear motion of a double-ended piston into rotational motion. Some devices have translated the linear motion to a crankshaft through connecting means that is located to the side of the cylinder, extending crosswise to the axis of the cylinder, such as those in U.S. Pat. No. 2,304,407 to HOGAN, issued Dec. 8, 1942, and U.S. Pat. No. 2,335,252 to APPEMAN, issued Nov. 30, 1943, entitled "Internal combustion engine."

In an effort to reduce the complexity of existing piston designs as well as reduce the vibrations from periodic unbalanced vertical inertial forces of pistons and connecting rods and lateral inertia forces created by crankshaft counterweights during rotation of the crankshaft, means were devised to have a crankshaft in direct mechanical contact with the piston. For example, the device taught in U.S. Pat. No. 4,485,768 to Heniges, issued Dec. 4, 1984, entitled "Scotch yoke engine with variable stroke and compression ratio," employs a variation of what is commonly referred to as a Scotch Yoke. The Scotch Yoke is also the subject of the devices disclosed in U.S. Pat. No. 5,331,926 to Vaux et al., issued Jul. 26, 1994, entitled "Dwelling scotch yoke engine," and U.S. Pat. No. 5,640,881 to Brackett, issued Jun. 24, 1997, entitled "Motion converter with pinion sector/rack interface." The Scotch Yoke, however, tends to cause wear on the slot in which the crankshaft runs through the piston.

In addition, the linear motion of the piston is imparted upon the crankshaft and translated into rotational motion through gearing or some other mechanical means by the crankshaft. The solution taught in U.S. Pat. No. 4,485,769 to Carson, issued Dec. 4, 1984, entitled "Engine," discloses a central hole through which a crankshaft rotates. However, that design requires counterbalancing to keep the crankshaft balanced within the piston rod, and does not provide a constant, solid mechanical engagement between the piston and the crankshaft.

What is needed, therefore, is a means to provide rotational motion directly onto the crankshaft without complicated devices or linkages that can cause power losses and include a large number of parts that can wear, break, and need lubrication. The new device should, as well, provide a continuous mechanical engagement between the crankshaft and the piston.

SUMMARY OF THE INVENTION

It is an object of the present invention to provide a novel reciprocating piston engine.

It is a further object of the present invention to provide a reciprocating piston engine with reduced power losses and fewer moving parts.

It is a further object of the present invention to provide a reciprocating piston engine with a connecting means between the piston and the crankshaft that reduces engine size.

It is a further object of the present invention to provide a reciprocating piston engine with a connecting means between the piston and crankshaft that increases efficiency and reduces power losses.

In a first embodiment, and in accordance with the above and further objects of the present invention that will be obvious to one skilled in the art, a piston assembly is attached to a crankshaft by two recessed annular gears, located on either side of the piston within cog lip plates. The piston has dual combustion chambers, with one each located at opposite ends of the piston. As combustion occurs in one combustion chamber, the piston is forced to move linearly away from the combustion chamber. As the piston moves in a linear direction, gear teeth on the crankshaft engaged within the recessed annular gears cause the geared portion of the crankshaft to be moved in a circular motion around the inside of the recessed annular gears, imparting a rotational motion on the crankshaft with a single rotation for each full linear movement of the piston. The crankshaft is offset so that lateral force is imparted through the crankshaft to an adjacent cylinder, which in turn imparts a lateral force on the cog engaged with the recessed annular gear.

In another embodiment, the piston has a single combustion chamber.

In another embodiment, the crankshaft is engaged by two or more pistons in series.

The present invention uses less material and space than current engine designs, even those using a Scotch Yoke, creating a lighter, more compact engine. The single piston design also allows for the motion of the crankshaft to be imparted independently of other cylinders. The reduced number of moving parts and the dual combustion chambers allows the engine to generate more power output with less energy loss than conventional internal combustion engines. Fuel efficiency is increased by the reduction of energy loss, reduction in materials and weight, with lower displacement than conventional internal combustion engines.

DESCRIPTION OF A PREFERRED EMBODIMENT

Figure 1:
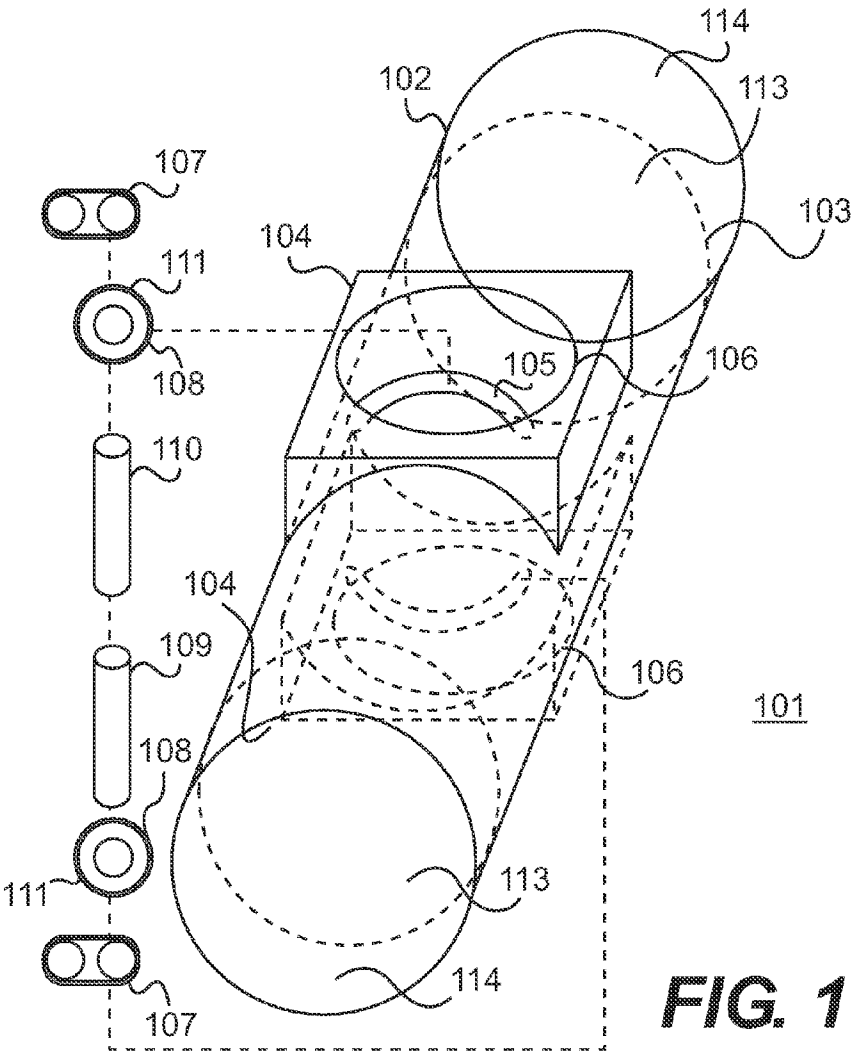
FIG. 1 is a perspective view of the piston and cylinder assembly.

Referring now to FIG. 1, the cylinder and piston assembly 101 comprises a cylinder 102, a piston 103, cog lip plate 104 on the outer surface of the cylinder 102, a slot 105 running horizontally through the piston 103, recessed annular gears 106 within the cog lip plate 104. There are two piston heads 113, which can be of regular or irregular shape such as flat, domed, notched, or wedged. The piston 103 can be constructed of iron, steel, alloy, or other material (such as high temperature plastics or ceramics).

Figure 3:
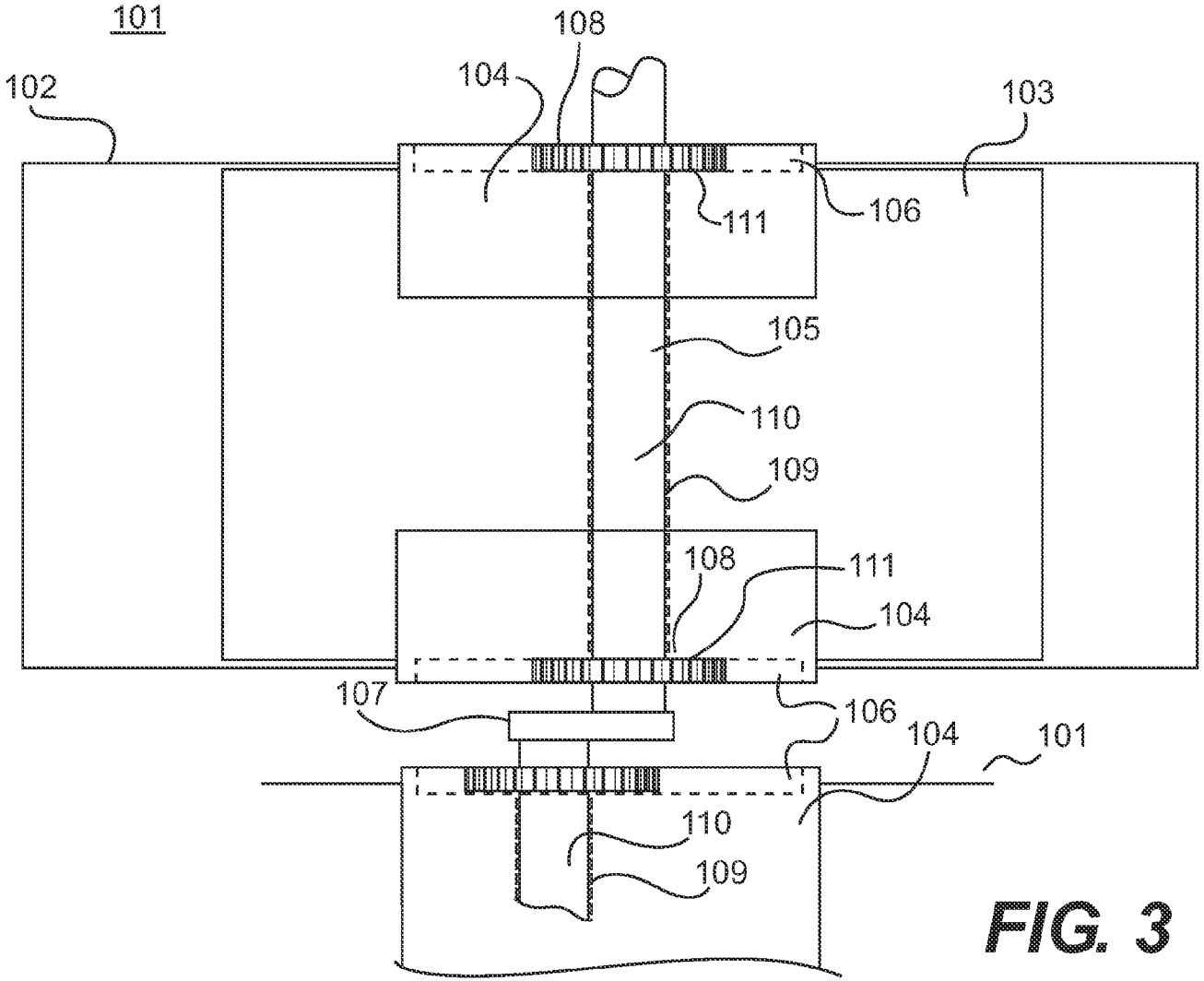
FIG. 3 is a top view of the crankshaft and piston assembly.

The cylinder and piston assembly 101 further comprises a crankshaft 110 within a crankshaft sleeve 109; the crankshaft 110 within the crankshaft sleeve 109 sit within the slot 105 in the piston 103. Affixed to opposite ends of the crankshaft sleeve 109 are cogs 108; the cogs 108 are located exterior to the piston 103 and the cylinder 102, but are located inside of the cog lip plates 104, where the cog gear teeth 111 correspond in size to the recessed annular gears 106 and the cog gear teeth 111 engage the recessed annular gears 106. The crankshaft 110 further comprises connecting braces 107, located at both ends of the crankshaft 110 and outside of the cogs 108 relative to the cylinder and piston assembly 101. The connecting braces 107 offset the crankshaft 110 from crankshafts for other cylinder and piston assemblies paired to the cylinder and piston assembly 101, as shown in FIG. 3, allowing firing sequences and timing to be determined based upon desired engine design and the number of cylinders utilized. It will be understood by those skilled in the art that the force imparted on the piston 103 can be generated by combustion within the combustion chambers 114, but may also be imparted by other means used to generate movement of pistons in engines and other mechanical devices, such as steam or other expanding gases, electromechanical forces, and the like.

As the piston 103 is moved in a reciprocating linear motion along the axis of the cylinder 102 as a result of combustion or other forces taking place within the combustion chambers 114, the cog 108 is moved rotationally about the recessed annular gear 106. As the cog 108 rotates, imparting a rotational motion upon the crankshaft 110, and the piston 103 moves up and down within the cylinder 102, the crankshaft 110 is free to move within the slot 105 in a reciprocating linear motion that is perpendicular to the reciprocating linear motion of the piston 103. This reciprocating linear motion of the crankshaft 110 allows the cog 108 to rotate through the full circumference of the recessed annular gear 106.

Figure 2:
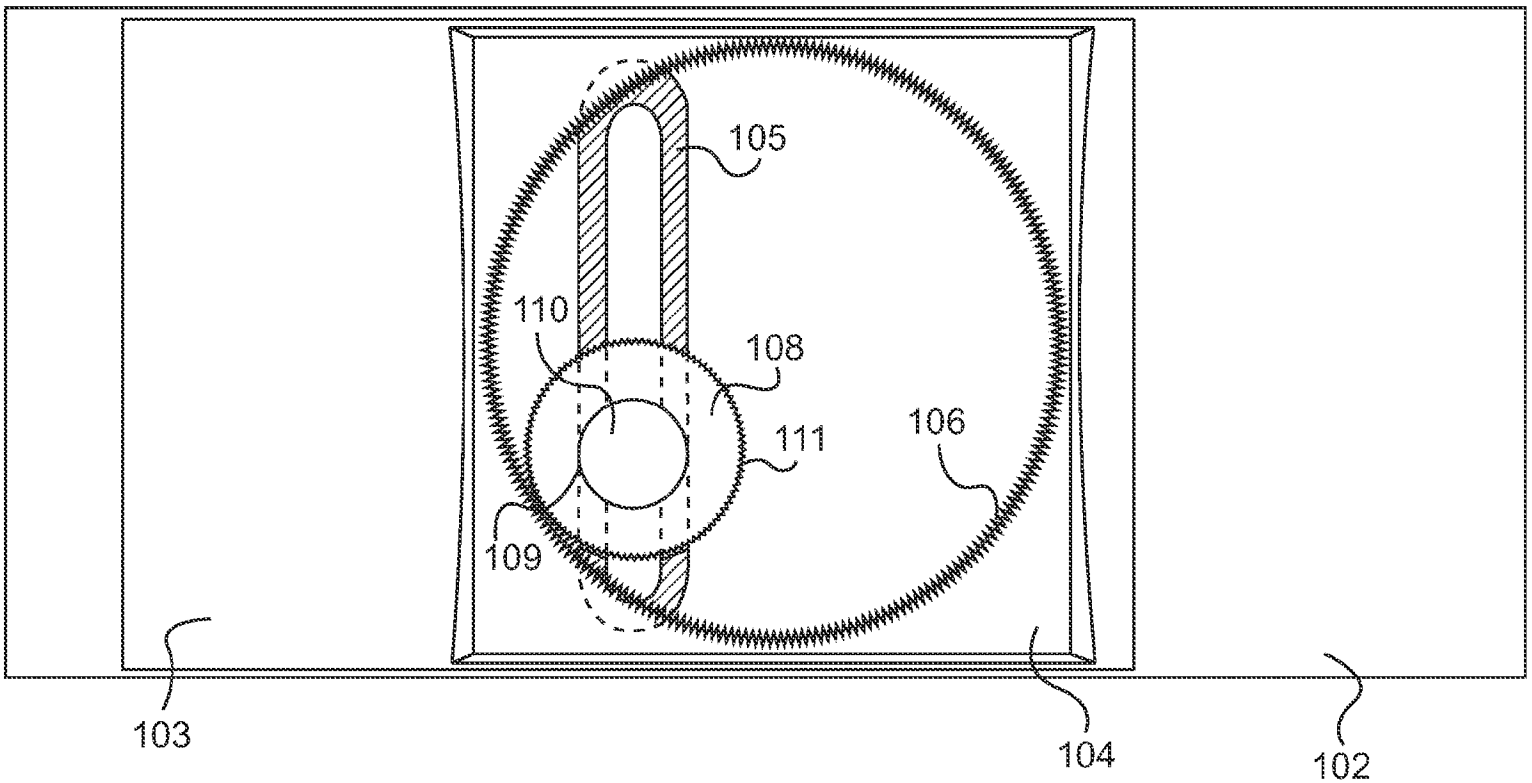
FIG. 2 is a front view of the crankshaft and piston assembly showing engagement of the crankshaft gearing with the recessed geared annular ring.

FIG. 2 is a front view of a cylinder and piston assembly 101, showing the cog 108 and the cog gear teeth 111 as engaged by the recessed annular gear 106 within the cog lip plate 104, with the crankshaft 110 and the crankshaft sleeve 109 residing within the slot 105 in the piston 103.

FIG. 3 is a top view of a cylinder and piston assembly 101 connected by the crankshaft 110 and connecting brace 107 to a second cylinder and piston assembly 101. As can be understood by this diagram, the rotational motion imparted upon the crankshaft 110 by the rotation of the cog 108 engaged within the recessed annular gear 106 is transmitted to one or more additional cylinder and piston assembly 101 through the connecting brace 107, which offsets the crankshaft 110 of the paired cylinder and piston assemblies. The offset of the crankshaft 110 transmits a force lateral to the slot 105, keeping the cog 108 engaged within the recessed annular gear 106 and causing the cog 108 to move laterally as well as vertically in relation to the vertical linear movement of the piston 103, such that the cog 108 moves rotationally within the recessed annular gear 106.

FIGS. 4A-4D is a view of the cylinder and piston assembly 101 showing rotation of the cog 108 within the recessed annular gear 106. As the piston 103 moves in a linear reciprocal motion within the cylinder 102, a lateral force is imparted upon the crankshaft 110 as a result of the offset imparted in the crankshaft 110 by the connecting brace 107 (as shown in FIG. 3). The lateral force imparted upon the crankshaft 110 keeps the teeth of the cog 108 engaged with the teeth of the recessed annular gear 106, and as the piston 103 moves linearly within the cylinder 102, the cog 108 moves around the inner portion of the recessed annular gear 106, imparting a rotational motion upon the cog 108 and thereby imparting the rotational motion upon the crankshaft 110.

Figure 4B:
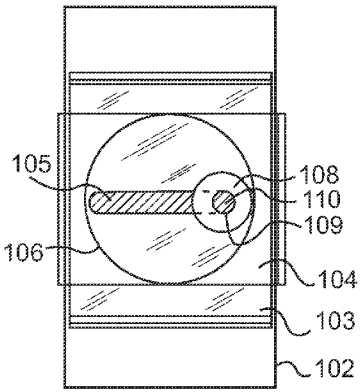
FIGS. 4A-4D shows rotation of the cog and crankshaft as the piston moves inside the cylinder.
Figure 4D:
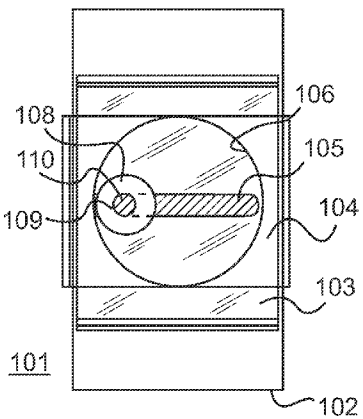
Figure 4A:
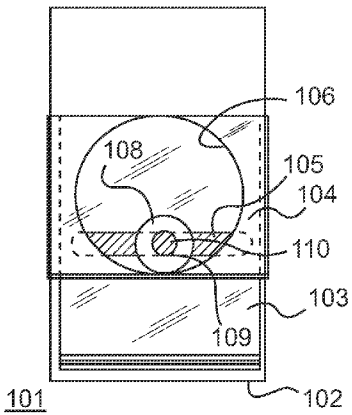
Figure 4C:
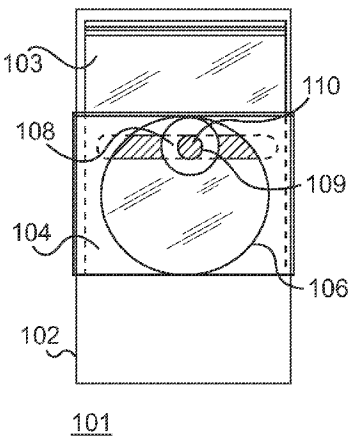

At the position shown in FIG. 4A, the piston 103 is at full extension of its linear movement at a first end of the cylinder 102. In that position, the crankshaft 110 is positioned in the center of the slot 105, and the cog 108 is located within the recessed annular gear 106 at the point closest to the first end of the cylinder 102. At the position shown in FIG. 4B, the piston 103 is one quarter of the way through a full reciprocal cycle, and is located at the midpoint of the cylinder 102. The crankshaft 110 has been moved laterally to a first end of the slot 105, and the cog 108 has moved through ninety degrees of the circumference of the recessed annular gear 106. At the position shown in FIG. 4C, the piston 103 is one half of the way through a full reciprocal cycle, and is located at a second end of the cylinder 102. The crankshaft 110 has been moved laterally to the center of the slot 105, and the cog 108 has moved through 180 degrees of the circumference of the recessed annular gear 106. At the position shown in FIG. 4D, the piston 103 is three quarters of the way through a full reciprocal cycle, and is located at the midpoint of the cylinder 102. The crankshaft 110 has been moved laterally to second end of the slot 105, and the cog 108 has moved through 270 degrees of the circumference of the recessed annular gear 106. Full cycle of the piston 103 returns the piston 103, the crankshaft 110, and the cog 108 to the positions shown in FIG. 4A.

The invention has been described in connection with a preferred embodiment thereof, and it should be clear to one skilled in the art that modifications and changes therein may be made by one skilled in the art without departing from the spirit and the scope of the invention. The details of the present invention as described are illustrative only, and do not limit the scope of the present invention as claimed below.

What is claimed is:

1. A first apparatus comprising:

a piston adapted to be reciprocating within a cylinder;

a crankshaft;

a cog with gear teeth;

a cylinder;

a crankshaft sleeve located around the crankshaft and affixed to the cog;

said piston having a slot through the center of said piston;

said crankshaft and crankshaft sleeve located within said slot through the center of said piston;

two cog lip plates located horizontally opposed on the outer portion of said cylinder;

recessed annular gear rings located within said cog lip plates and engaging the cog so as to rotate the sleeve about the crankshaft; and one or more connecting braces located on said crankshaft.

2. The first apparatus of claim 1, where said first apparatus is joined in series with a second apparatus, said second apparatus comprising:

a piston adapted to be reciprocating within a cylinder;

a crankshaft;

a cog with gear teeth;

a cylinder;

a crankshaft sleeve located around the crankshaft and affixed to the cog;

said piston having a slot through the center of said piston;

said crankshaft and crankshaft sleeve located within said slot through the center of said piston;

two cog lip plates located horizontally opposed on the outer portion of said cylinder;

recessed annular gear rings located within said cog lip plates and engaging the cog so as to rotate the sleeve about the crankshaft; and one or more connecting braces located on said crankshaft;

said second apparatus having said crankshaft attached by a connecting brace to said crankshaft of said first apparatus.

3. The first apparatus of claim 1 wherein said piston comprises two piston heads.

4. The first apparatus of claim 1 wherein said cylinder further comprises one or more combustion chambers.

5. The first apparatus of claim 1 wherein said connecting braces impart a lateral force upon said crankshaft.

* * * * *